US006658879B2

(12) United States Patent
Park et al.

(10) Patent No.: US 6,658,879 B2
(45) Date of Patent: Dec. 9, 2003

(54) DIRECT COOLING TYPE REFRIGERATOR

(75) Inventors: Jin-Koo Park, Gwangmyeong (KR); Yang-Kyu Kim, Seoul (KR); Se-Young Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/175,047

(22) Filed: Jun. 20, 2002

(65) Prior Publication Data

US 2003/0094009 A1 May 22, 2003

(30) Foreign Application Priority Data

Nov. 16, 2001 (KR) ..... 2001-71479

(51) Int. Cl.[7] ..... F25B 1/00; F25D 11/02

(52) U.S. Cl. ..... 62/229; 62/441; 62/443; 62/440; 62/238.6; 62/434

(58) Field of Search ..... 62/440, 238.6, 62/430, 434, 229, 441, 443

(56) References Cited

U.S. PATENT DOCUMENTS 4,637,222 A * 1/1987 Fujiwara et al. ..... 62/244
5,337,579 A * 8/1994 Saia, III et al. ..... 62/239
6,327,867 B1 * 12/2001 Hyodo et al. ..... 62/187
6,370,908 B1 * 4/2002 James ..... 62/434
6,451,364 B1 * 9/2002 Ito ..... 426/244
6,463,755 B2 * 10/2002 Schulak et al. ..... 62/440

* cited by examiner

*Primary Examiner*—Timothy L. Maust
*Assistant Examiner*—Mark Shulman
(74) *Attorney, Agent, or Firm*—Birch, Stewart, Kolasch & Birch, LLP

(57) ABSTRACT

A direct cooling type refrigerator includes: a main body with a certain space for keeping food items; a freezing chamber formed at an upper portion of the main body and keeping frozen food items; a refrigerating chamber sectioned by a barrier with the freezing chamber, formed at a lower portion of the main body and keeping refrigerated food items; a freezing chamber evaporator buried in a side wall of the freezing chamber and directly heat-exchanged with air inside the freezing chamber; and a refrigerating chamber evaporator buried in a side wall of the refrigerating chamber and directly heat-exchanged with air inside the refrigerating chamber. Since the refrigerating chamber is cooled by both the refrigerating chamber evaporator and the cooling air supplied from the freezing chamber, the temperature of the refrigerating chamber can be quickly dropped to promptly cope with a load introduced to the refrigerating chamber, and since the temperature of the refrigerating chamber is constantly maintained at a proper level, the freshness of food items can be improved.

6 Claims, 4 Drawing Sheets

DIRECT COOLING TYPE REFRIGERATOR

BACKGROUND OF THE INVENTION

1. Field of the Invention

The present invention relates to a direct cooling type refrigerator, and more particularly, to a direct cooling type refrigerator that is capable of improving a refrigerating performance of a refrigerating chamber and capable of minimizing a temperature change in the refrigerating chamber.

2. Description of the Background Art

In general, a refrigerator is sectioned into a freezing chamber for keeping frozen food items and a refrigerating chamber for keeping refrigerated food items, and includes a freezing cycle to supply cooling air to the freezing chamber and the refrigerating chamber therein.

The refrigerator is classified into a direct cooling type refrigerator of natural convection in which air inside a refrigerator and an evaporator directly come in contact with to perform a cooling operation, and an indirect cooling type refrigerator in which a duct for flowing cooling air is formed inside a refrigerator and the cooling air is blown into the refrigerator by a blast fan to thereby perform a cooling operation.

The direct cooling type refrigerator is mainly used for a small-size refrigerator with a small capacity, while the indirect cooling type refrigerator is mainly used for a large scale refrigerator with a large capacity.

FIG. 1 is a sectional view of the direct cooling type refrigerator in accordance with the background art.

The direct cooling type refrigerator shown in FIG. 1 includes a main body 104 having a certain space for storing food items and having a door 102 (not shown) mounted to be opened and closed at an opened front side of the main body 104; a freezing chamber 106 formed at an upper side of the main body 104 and storing frozen food items; a refrigerating chamber 108 partitioned with the freezing chamber 106 by a barrier 110 and formed at a lower portion of the main body 104 to store refrigerated food items; and a freezing cycle containing an evaporator 112 buried in the side wall of the freezing chamber 106 and performing a cooling operation by directly contacting the air inside the freezing chamber 106.

The freezing chamber 106 is formed at an upper portion of the main body 104, and a refrigerating chamber door 114 is separately installed at an opened front side of the main body 104.

The barrier 110 is installed between the refrigerating chamber 108 and the freezing chamber 106, and a plurality of shelves 128 are mounted in the refrigerating chamber 108 at regular intervals to receive food items.

The barrier 110 is formed as a tray type detachably mounted at one side of the main body 104, and has a plurality of cooling air supply passages 116 for supplying cooling air generated from the freezing chamber 106 to the refrigerating chamber 108.

The evaporator 112 is buried inside at least one of the side walls, e.g., a side wall other than the opening side where the refrigerating chamber door 114 is mounted over the refrigerating chamber 106, and in direct contact with air inside the freezing chamber 106 to perform a cooling operation.

A temperature sensor 118 is attached at one side of the evaporator 112 to detect a temperature of the freezing chamber 106 to turn on/off the freezing system.

As shown in FIG. 2, the freezing system of the background art includes a compressor 120 for raising a gas refrigerant in a low temperature and low pressure state to a gas coolant of high temperature and a high pressure; a condenser 122 for cooling and condensing the refrigerant in the high temperature and high pressure state introduced from the compressor 120 by an ambient air; an expansion valve 124 for decompressing the refrigerant introduced from the condenser 122; and an evaporator 112 for evaporating the refrigerant decompressed in the expansion valve 124 at the low pressure and low temperature state and allowing the refrigerant to directly contact the air of the freezing chamber 106 to thereby perform a cooling operation.

In the above-described direct cooling type refrigerator, as the freezing system is driven, the air inside the freezing chamber 106 comes in contact with the evaporator 112 to cool the freezing chamber 106, and after the cooling air completes the cooling operation while circulating the freezing chamber 106, the cooling air is supplied to the refrigerating chamber 108 through the cooling air supply passage 116 of the barrier 110 to perform a cooling operation of the refrigerating chamber 108.

However, the conventional direct cooling type refrigerator has the following problems.

That is, since the evaporator is installed only in the freezing chamber and the cooling air generated in the freezing chamber is supplied to the refrigerating chamber, the cooling performance of the refrigerating chamber is degraded, a cooling time for maintaining the temperature in the refrigerating chamber to a proper level increases, and the freshness of refrigerated food items kept in the refrigerating chamber is degraded.

SUMMARY OF THE INVENTION

Therefore, an object of the present invention is to provide a direct cooling type refrigerator that is capable of quickly dropping a temperature of a refrigerating chamber to a suitable level and thus improving freshness of refrigerated food items kept in the refrigerating chamber by installing an evaporator in the refrigerating chamber as well as in a freezing chamber to make a heat exchange with air inside the refrigerating chamber.

Another object of the present invention is to provide a direct cooling type refrigerator that is capable of improving an efficiency of a freezing cycle and reducing a power consumption by attaching a temperature sensor to an evaporator installed in a freezing chamber to control a system.

To achieve these and other advantages and in accordance with the purpose of the present invention, as embodied and broadly described herein, there is provided a direct cooling type refrigerator including: a main body with a certain space for keeping food items; a freezing chamber formed at an upper portion of the main body and keeping frozen food items; a refrigerating chamber sectioned by a barrier with the freezing chamber, formed at a lower portion of the main body and keeping refrigerated food items; a freezing chamber evaporator buried in a side wall of the freezing chamber and directly heat-exchanged with air inside the freezing chamber; and a refrigerating chamber evaporator buried in a side wall of the refrigerating chamber and directly heat-exchanged with air inside the refrigerating chamber.

The direct cooling type refrigerator of the present invention further includes: a temperature sensor attached to the freezing chamber evaporator and detecting a temperature of the freezing chamber; and a control unit for turning off/off a freezing cycle of a refrigerator so that the temperature of the freezing chamber and the refrigerating chamber can be maintained at a suitable level according to an electric signal applied from the temperature sensor In the direct cooling type refrigerator of the present invention, the refrigerating chamber evaporator is formed as a flat plate type buried in a rear wall of the refrigerating chamber.

In the direct cooling type refrigerator of the present invention, the refrigerating chamber evaporator is formed as a bent flat plate type integrally buried in a rear wall and left and right side walls of the refrigerating chamber.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

There may be a plurality of embodiments of a direct cooling type refrigerator in accordance with the present invention, of which the most preferred one will now be described.

Figure 1:
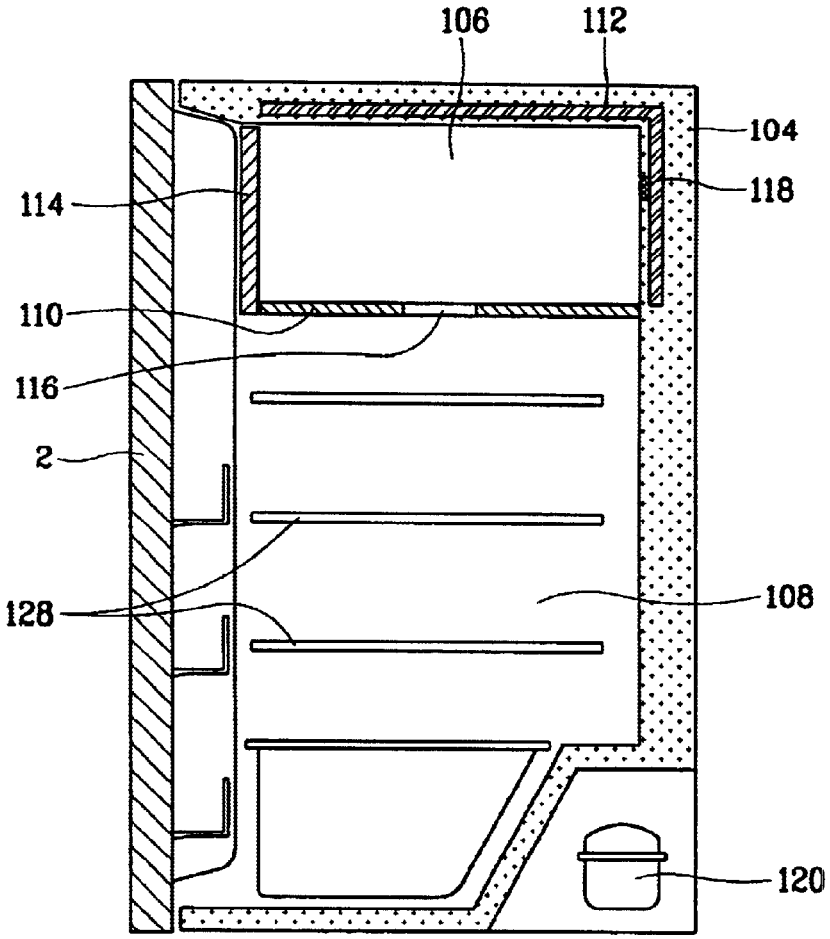
FIG. 1 BACKGROUND ART
FIG. 1 is a sectional view showing a direct cooling type refrigerator in accordance with the background art.
Figure 2:
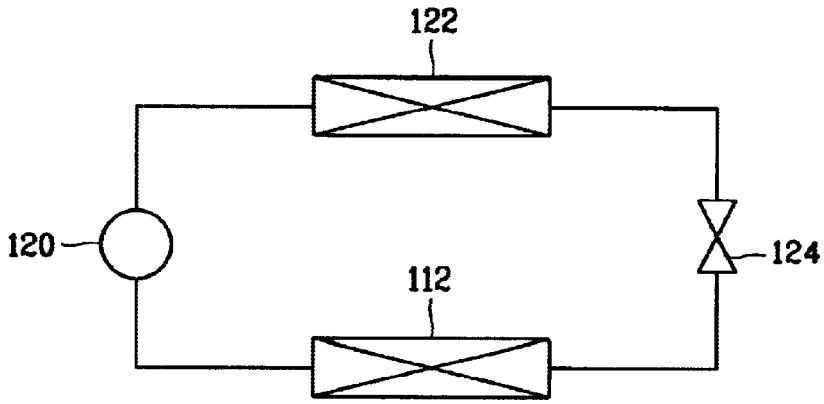
FIG. 2 BACKGROUND ART
FIG. 2 is a view showing the construction of a freezing cycle of the direct cooling type refrigerator in accordance with the background art.
Figure 3:
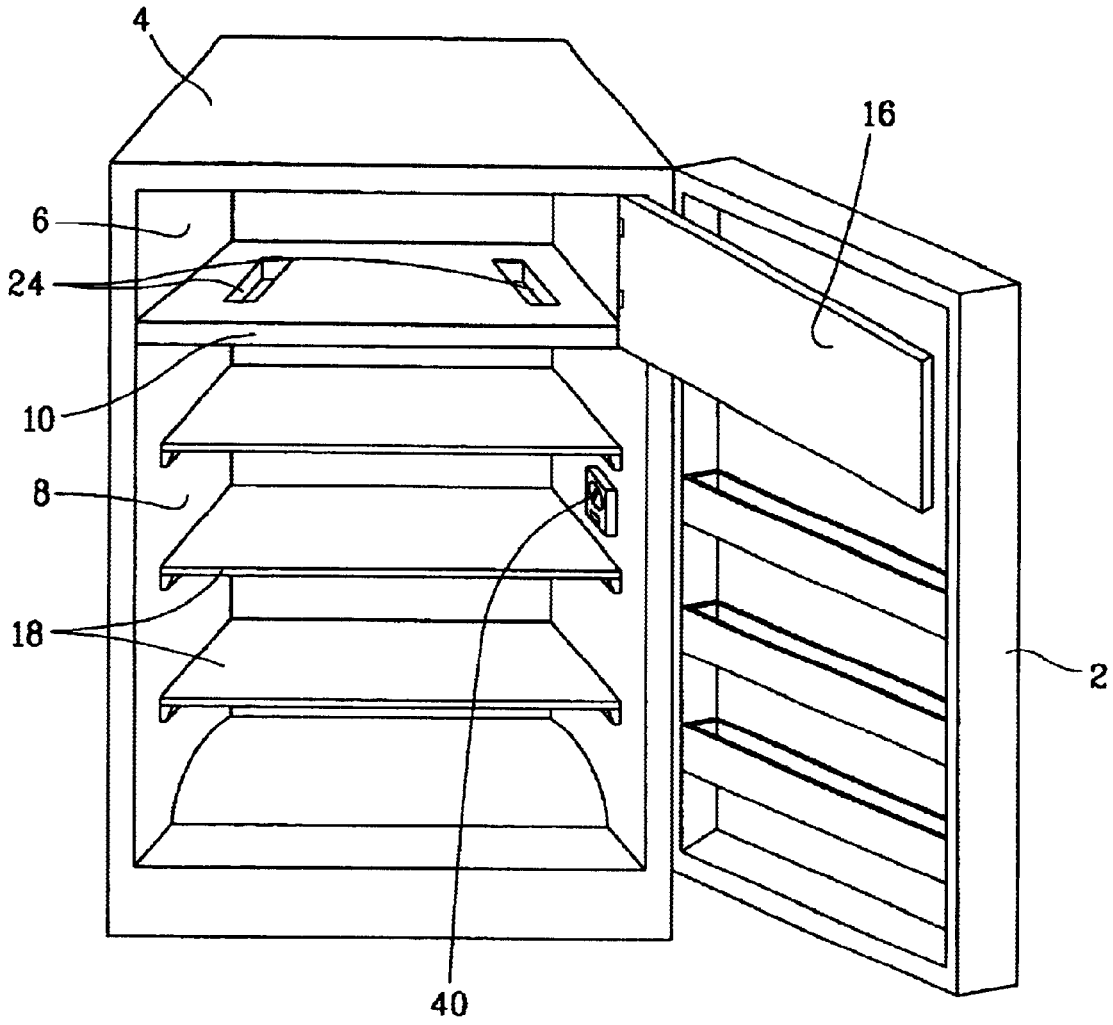
FIG. 3 is a perspective view of a direct cooling type refrigerator in accordance with the present invention.
Figure 4:
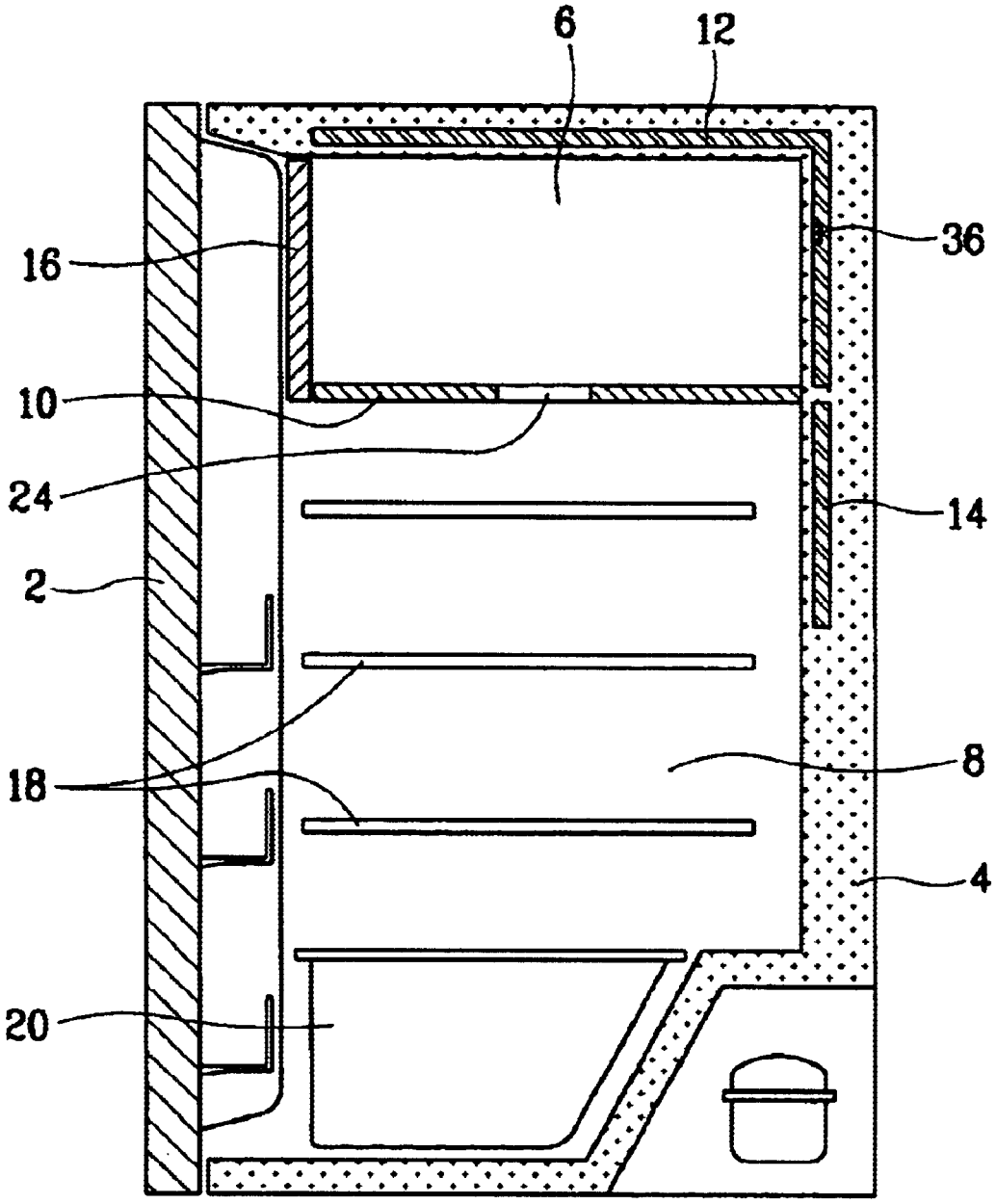
FIG. 4 is a sectional view showing the direct cooling type refrigerator in accordance with the present invention.

FIG. 3 is a perspective view of a direct cooling type refrigerator in accordance with the present invention, and FIG. 4 is a sectional view showing the direct cooling type refrigerator in accordance with the present invention.

The direct cooling type refrigerator of the present invention includes: a main body 4 having a heat-insulated space to keep food items and a door 2 mounted at an opened front side to be opened and closed; a freezing chamber 6 formed at an upper portion of the main body 4 and keeping frozen food items; a refrigerating chamber 8 sectioned by a barrier 10 with the freezing chamber 6, formed at a lower portion of the main body 4 and keeping refrigerated food items; a freezing cycle having evaporators 12 and 14 disposed buried in a circumferential side of the freezing chamber 6 and the refrigerating chamber 8 and performing a cooling operation in a direct contact manner with the air inside the freezing chamber 6 and the refrigerating chamber 8; and a controller for turning on/off the freezing cycle according to a temperature of the freezing chamber 6 so as to maintain the temperature of the freezing chamber 6 to a proper level.

The freezing chamber 6 is formed at an upper portion of the main body 4, and a freezing chamber door 16 is mounted at an opened front side of the main body 4 so as to be opened and closed. And, the freezing chamber evaporator 12 for making a direct heat exchange with the air inside the freezing chamber is buried in at least more than one of side walls except for the opened front side.

If the freezing chamber evaporator 12 is buried in the upper wall and the rear wall of the freezing chamber 6, it may be formed as a flat plate type bent at a right angle. If the freezing chamber evaporator 12 is buried in both side walls, it may be formed as a box type with rear side and front side opened.

The refrigerating chamber 8 is formed at a lower portion of the main body 4, in which a plurality of shelves 18 are disposed at regular intervals for keeping food items, and a vegetable box 20 is received at a lower side to keep vegetables.

The refrigerating chamber evaporator 14 for directly heat-exchanging air inside the refrigerating chamber 8 is buried in at least more than one side walls and the rear wall of the refrigerating chamber 8.

The refrigerating chamber evaporator 14 is connected to the freezing chamber evaporator 12 through a refrigerant pipe (not shown) so that a refrigerant can be introduced into the refrigerating chamber evaporator 14 after passing the freezing chamber evaporator 12. The refrigerating chamber evaporator 14 is buried in at least more than one of rear wall or both side walls of the refrigerating chamber 8.

If the refrigerating chamber evaporator 14 is buried in the rear wall of the refrigerating chamber 8, it is formed as a flat plate type. Meanwhile, if the refrigerating chamber evaporator 14 is buried in both side walls, it is formed as a bent flat plate type.

The barrier 10, sectioning the freezing chamber 6 and the refrigerating chamber 8, is installed detachably at the main body 4 and includes a plurality of cooling air supply passages 24 for supplying cooling air generated from the freezing chamber 6 to the refrigerating chamber 8.

Figure 5:
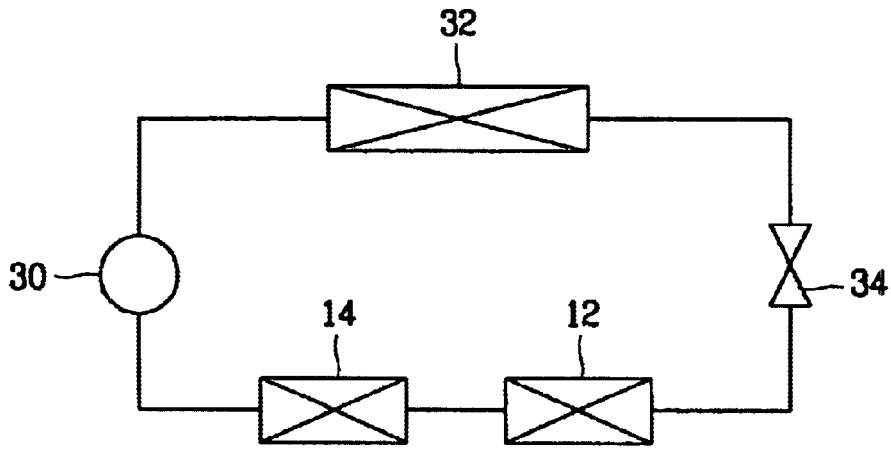
FIG. 5 is a view showing the construction of a freezing cycle of the direct cooling type refrigerator in accordance with the present invention.

As shown in FIG. 5, the freezing cycle includes: a compressor 30 for raising a gas refrigerant in a low temperature and low pressure state to a high temperature and high pressure; a condenser 32 for cooling and condensing the high temperature and high pressure refrigerant introduced from the compressor 30 by an ambient air; an expansion valve 34 for decompressing the refrigerant introduced from the condenser 32; the freezing chamber evaporator 12 in which the refrigerant decompressed in the expansion valve 34 directly contacts the air inside the freezing chamber 8 while being evaporated at a low pressure and low temperature state, thereby performing a cooling operation; and the refrigerating chamber evaporator 14 in which the refrigerant is introduced after passing the freezing chamber evaporator 12, directly contact the air inside the refrigerating chamber 8 whiling being evaporated at the low pressure and low temperature state, thereby performing a heat exchange.

Figure 6:
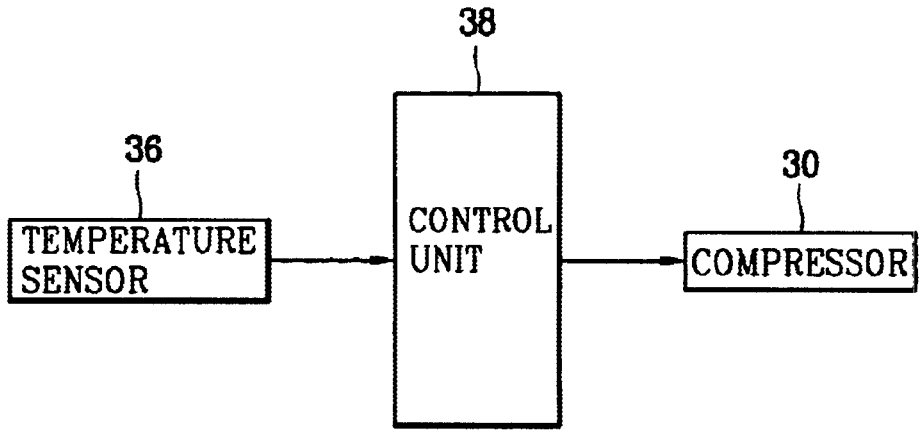
FIG. 6 is a view showing a block diagram of a control system of the direct cooling type refrigerator in accordance with the present invention.

As shown FIG. 6, The controller 38 adopts a constant cut-in method, a method for mechanically controlling a temperature of the refrigerating chamber and the freezing chamber.

That is, a temperature sensor 36 is attached at one side of the freezing chamber evaporator 12 to detect a temperature of the freezing chamber 6, and the temperature sensor 36 is turned on at one specific temperature and turned off at another specific temperature.

In detail, when a user manipulates a temperature control knob 40 and sets a certain temperature, the temperature sensor 36 effectively turns the compressor 30 on or off within the temperature range selected by the temperature control knob 40 to maintain the temperature of the refrigerating chamber 8 and the freezing chamber 6 at a proper level.

The temperature control knob 40 is installed at one wall side of the refrigerating chamber 8 so that the user can control the temperature as desired.

In the direct cooling type refrigerator constructed as described above, when the power is ON, the freezing cycle is driven, and the air inside the freezing chamber 6 is directly in contact with the freezing chamber evaporator 12 for a heat-exchange, to thereby perform a cooling operation, and then, the cooling air, which has completed the cooling operation while circulating the freezing chamber 6, is supplied to the refrigerating chamber 8 through the cooling air supply passage 24 to perform a cooling operation of the refrigerating chamber 8.

The air inside the refrigerating chamber 8 directly contact the refrigerating chamber evaporator 14 buried in the side wall of the refrigerating chamber 8 and heat-exchanged, thereby performing a cooling operation of the refrigerating chamber 8.

During the operation, when the user selects a certain temperature by manipulating the temperature control knob 40, the temperature sensor 36 is mechanically turned on/off within the temperature range selected by the temperature control knob 40 to maintain the temperature of the refrigerating chamber 8 and the freezing chamber 6 at a proper level.

As so far described, the direct cooling type refrigerator of the present invention has many advantages.

That is, for example, the freezing chamber evaporator being in contact with the air inside the freezing chamber is installed at the side wall of the freezing chamber and the refrigerating chamber evaporator being in contact with the air inside the refrigerating chamber is installed at the side wall of the refrigerating chamber so as to perform the cooling operation. Thus, since the refrigerating chamber is cooled by both the refrigerating chamber evaporator and the cooling air supplied from the freezing chamber, the temperature of the refrigerating chamber can be quickly dropped to promptly cope with a load introduced to the refrigerating chamber, and since the temperature of the refrigerating chamber is constantly maintained at a proper level, the freshness of food items can be improved.

In addition, the temperature sensor is installed at the evaporator of the freezing chamber and the constant cut-in method is adopted for a temperature control method. Thus, when the user selects a desired temperature by manipulating the temperature control knob, the temperature sensor is mechanically operated to be turned on/off within a certain temperature range to maintain the temperature of the freezing chamber and the refrigerating chamber at a proper level. Accordingly, an efficiency of the freezing cycle is improved and a power consumption is reduced.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such metes and bounds are therefore intended to be embraced by the appended claims.

What is claimed is:

1. A direct cooling refrigerator comprising:

a main body with a certain space for keeping food items;

a freezing chamber formed at an upper portion of the main body for keeping frozen food items;

a refrigerating chamber sectioned from the freezing chamber by a barrier, said refrigerating chamber being formed at a lower portion of the main body and being capable of keeping refrigerated food items;

a freezing chamber evaporator buried in a side wall of the freezing chamber and providing direct heat exchange with air inside the freezing chamber;

a refrigerating chamber evaporator buried in a side wall of the refrigerating chamber and directly heat-exchanged with air inside the refrigerating chamber; and a freezing chamber temperature sensor being attached at one side of said freezing chamber evaporator, wherein said temperature sensor detects a temperature of said freezing chamber;

wherein the barrier is formed as a drip type detachably installed between the refrigerating chamber and the freezing chamber.

2. The refrigerator according to claim 1, wherein a temperature manipulating knob is installed with which a user selects a temperature.

3. The refrigerator according to claim 2, wherein the temperature sensor adopts a constant cut-in (CCI) method so that the temperature sensor is mechanically turned on/off within a temperature range selected by the temperature manipulating knob.

4. The refrigerator according to claim 1, wherein the freezing chamber evaporator is formed as a flat plate evaporator buried in at least more than one wall of the freezing chamber.

5. The refrigerator according to claim 1, wherein the refrigerating chamber evaporator is formed as a flat plate evaporator buried in a rear wall of the refrigerating chamber.

6. The refrigerator according to claim 1, wherein the refrigerating chamber evaporator is formed as a bent flat plate evaporator integrally buried in a rear wall and left and right side walls of the refrigerating chamber.

* * * * *